US011937702B2

(12) United States Patent
Charpiot

(10) Patent No.: US 11,937,702 B2
(45) Date of Patent: Mar. 26, 2024

(54) AIR INFLATABLE DEVICE SUCH AS A LEISURE DEVICE PROVIDED WITH A QUICK CLOSURE MEANS

(71) Applicant: Geoffrey Charpiot, Montauroux (FR)

(72) Inventor: Geoffrey Charpiot, Montauroux (FR)

( * ) Notice: Subject to any disclaimer, the term of this patent is extended or adjusted under 35 U.S.C. 154(b) by 270 days.

(21) Appl. No.: 17/603,623

(22) PCT Filed: Apr. 17, 2020

(86) PCT No.: PCT/EP2020/060821
§ 371 (c)(1),
(2) Date: Oct. 14, 2021

(87) PCT Pub. No.: WO2020/212555
PCT Pub. Date: Oct. 22, 2020

(65) Prior Publication Data

US 2022/0192390 A1 Jun. 23, 2022

(30) Foreign Application Priority Data

Apr. 18, 2019 (FR) ..... 1904174

(51) Int. Cl.
*A47C 27/08* (2006.01)
*A47C 27/00* (2006.01)

(52) U.S. Cl.
CPC ..... *A47C 27/081* (2013.01); *A47C 27/088* (2013.01); *A47C 27/08* (2013.01)

(58) Field of Classification Search
CPC ..... A47C 27/081; A47C 27/088; A47C 27/08; A61G 7/05769
USPC ..... 5/706, 709, 654, 655.3, 644
See application file for complete search history.

(56) References Cited

U.S. PATENT DOCUMENTS 1,950,571 A * 3/1934 Benjamin ..... A47C 27/084 383/61.3
5,240,112 A * 8/1993 Newburger ..... B65D 75/5877 383/41
6,212,716 B1 * 4/2001 Logan, Jr. ..... A47G 9/1027 5/636
10,405,663 B2 * 9/2019 Yang ..... A47C 4/54
2006/0236463 A1 * 10/2006 Metcalf ..... A47C 27/088 5/709

(Continued)

FOREIGN PATENT DOCUMENTS

CN 205947556 U 2/2017
CN 206782389 U 12/2017

(Continued)

*Primary Examiner* — Robert G Santos
(74) *Attorney, Agent, or Firm* — Meunier Carlin & Curfman LLC

(57) ABSTRACT

Device (10, 110, 210) including at least one flexible pouch (12, 21, 22) delimiting an interior volume, one air inlet opening (13) per flexible pouch to allow air to pass into an interior volume of the pouch, a closure for closing the air inlet in an airtight manner, the closure including two flexible strips (14, 16) located at the periphery of the air inlet opening, the strips being connected at their ends and adapted to be pressed against one another. A rigid movable part (24, 25, 26) is pivotally connected to one of the ends of the strips so that the movable part can be positioned around the strips in a closed position in which the two strips are kept clamped together so as to prevent air from escaping the device.

18 Claims, 6 Drawing Sheets

(56) References Cited

U.S. PATENT DOCUMENTS

| | | | | |
|---|---|---|---|---|
| 2018/0317657 | A1 | 11/2018 | Yang | |
| 2022/0192390 | A1 * | 6/2022 | Charpiot | A47C 27/081 |

FOREIGN PATENT DOCUMENTS

| | | | | | |
|---|---|---|---|---|---|
| DE | 9419699 | U1 | | 2/1995 | |
| FR | 3095117 | A1 | * | 10/2020 | A47C 27/081 |
| FR | 3095117 | B1 | * | 5/2021 | A47C 27/081 |
| WO | 2018034561 | A1 | | 2/2018 | |
| WO | WO-2020212555 | A2 | * | 10/2020 | A47C 27/081 |

* cited by examiner

AIR INFLATABLE DEVICE SUCH AS A LEISURE DEVICE PROVIDED WITH A QUICK CLOSURE MEANS

The present invention relates to the technical field of inflatable objects such as an inflatable mattress and that of air-fillable bags and relates in particular to a device to be filled with air such as a leisure device provided with a fast closure means.

BACKGROUND ART

There are inflatable objects or air-fillable bags which are filled with air very quickly thanks to a wide opening and which are provided with an airtight closure means. To prevent air from escaping after filling the object, it must be possible to install the airtight closure means quickly.

For example, there are inflatable bags whose opening is provided with flexible strips. Once the opening is closed, the two strips are against each other and are rolled upon themselves and on the neck of the bag opening. The two strips are then bent so that the neck of the bag opening has a curved profile. The two strips, held tight against each other by the elastic action from their curvature, prevent air from escaping the bag. This curved position is maintained by means of two complementary coupling devices located at each end of the strips, respectively, which cooperate by means of clipping. This device is described, for example, in document WO2018034561A1.

The drawback of such a device lies in the fact that the closure means requires that the neck of the bag opening be rolled upon itself and then curved to guarantee airtightness. Therefore, once inflated, the bag cannot take the form of a perfectly flat mattress, for example.

This is why the aim of the invention is to provide an air-fillable device provided with a large opening and closure means allowing the bag to be closed rapidly, and which avoids the need of bending the neck of the bag opening onto itself.

The object of the invention is thus a device comprising at least one flexible pouch delimiting an interior volume, one air inlet opening per flexible pouch to allow air to pass into the interior volume of the pouch, a closure means for closing the air inlet in an airtight manner, the closure means comprising two flexible strips located at the periphery of the air inlet opening, the strips being connected at their ends and intended to be pressed against one another.

According to the main feature, the device comprises at least one rigid movable part pivotally connected to one of the ends of the strips such that the movable part can be positioned around the strips in a closed position in which the two strips are kept clamped together so as to prevent air from escaping the device when the latter is filled with air.

BRIEF DESCRIPTION OF THE DRAWINGS

The purposes, objects and characteristics of the invention will become more apparent from the following description when taken in conjunction with the accompanying drawings in which.

DETAILED DESCRIPTION OF THE INVENTION

The device 10 according to the invention comprises a flexible pouch 12 delimiting an interior volume. According to the preferred embodiment, the device according to the invention is a leisure device such as a mattress for the beach or camping or any other use. The rectangular-shaped pouch is preferably made of polyvinyl chloride (PVC). The use of another flexible yet robust material such as polyurethane, fabric, plastic or coated fabric is possible as long as it is airtight.

Figure 1:
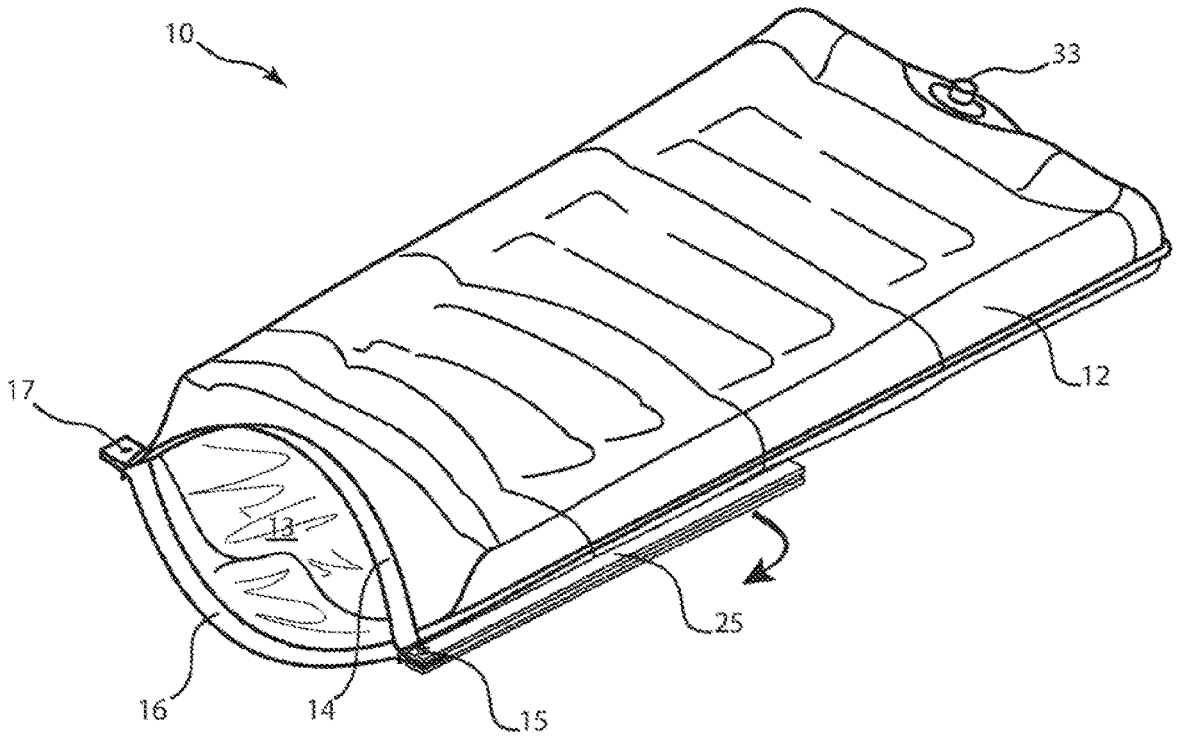
FIG. 1 represents the device according to the invention with one movable part and in position to fill it with air.
Figure 3:
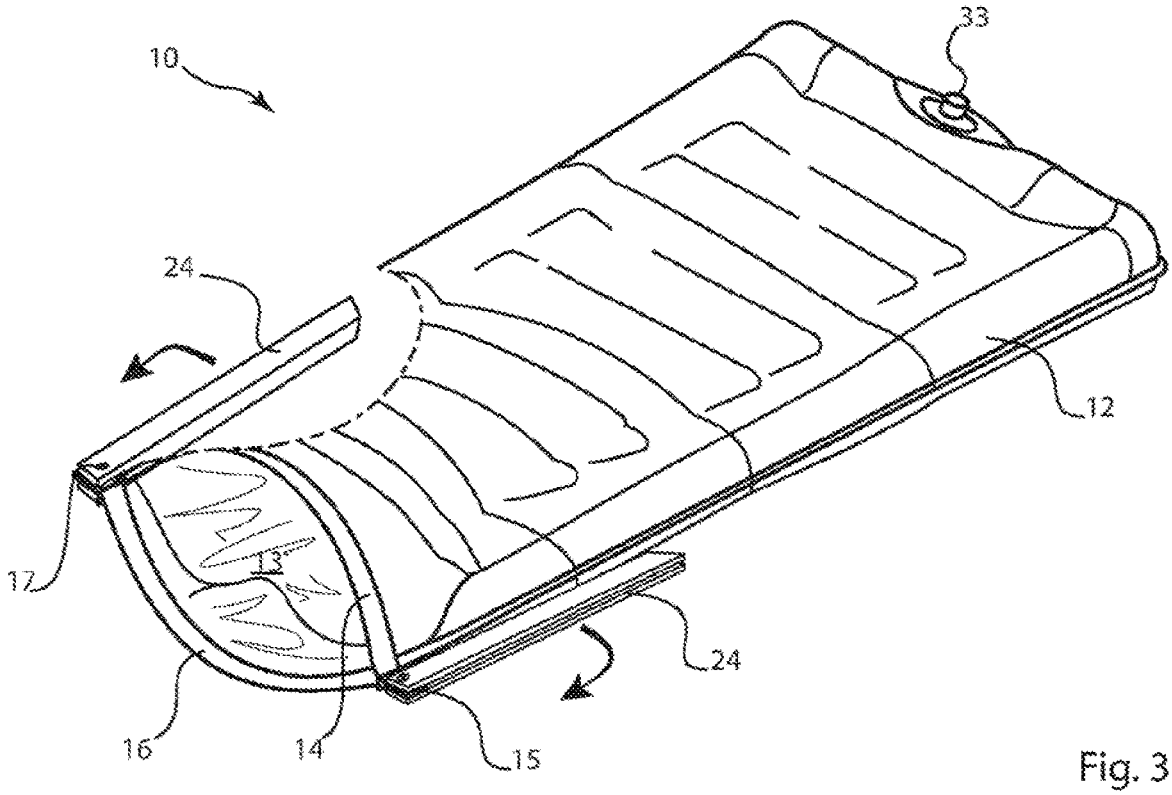
FIG. 3 represents the device according to the invention with two movable parts and in position to fill it with air.

The leisure device comprises an opening 13, which is relatively large compared to the dimensions of the pouch. The opening 13 is located on one of the short sides of the leisure device and its width is substantially equal to that of the leisure device. Thanks to this opening, air can enter the pouch quickly. The leisure device is also provided with means for closing the opening 13. These means comprise two flexible strips 14 and 16 located at the periphery of the opening 13. In the rest position, these two strips are superimposed and are held tight against one another at their two ends by a screw type clamping means 15 and 17 or by any other means. The two strips can be separated from each other by grasping them them in their center in an opening position of the pouch 12, as illustrated in FIGS. 1 and 3. During this operation, the flexible strips 14 and 16 are curved intentionally. The dimensions of the strips, and particularly their thickness and the material from which they are made, allow for this elastic deformation. The strips 14 and 16 are preferably made of plastic.

Figure 2:
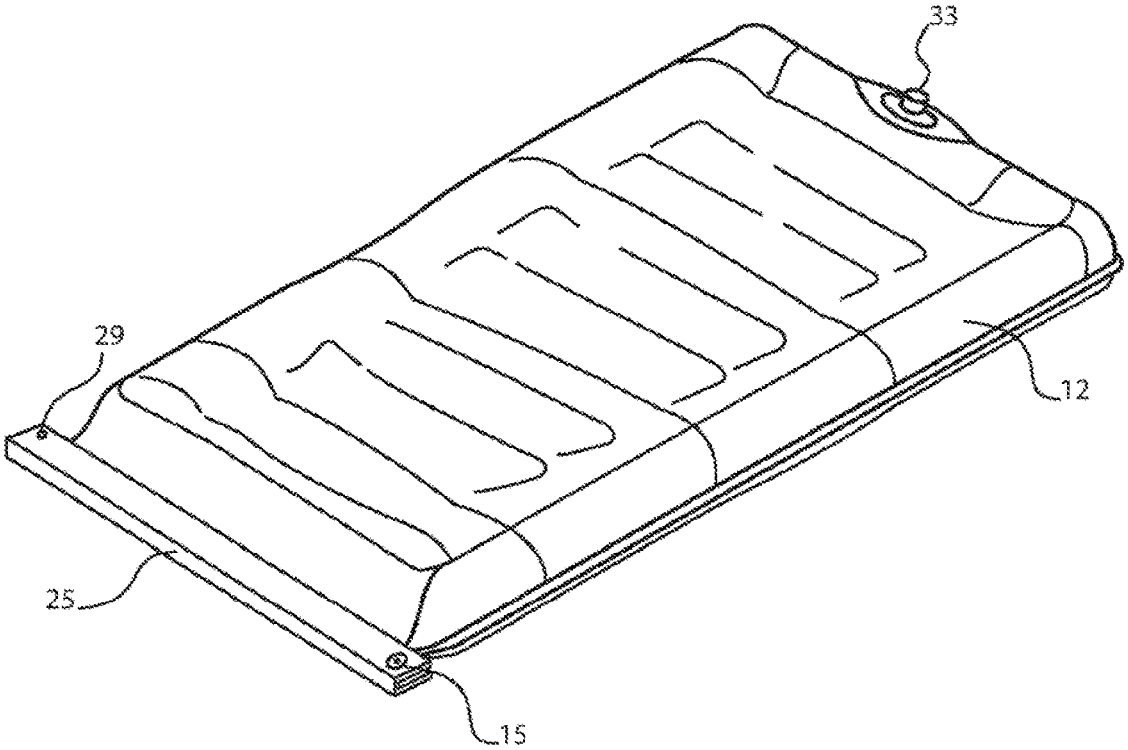
FIG. 2 represents an overview of the device provided with only one movable part.
Figure 4:
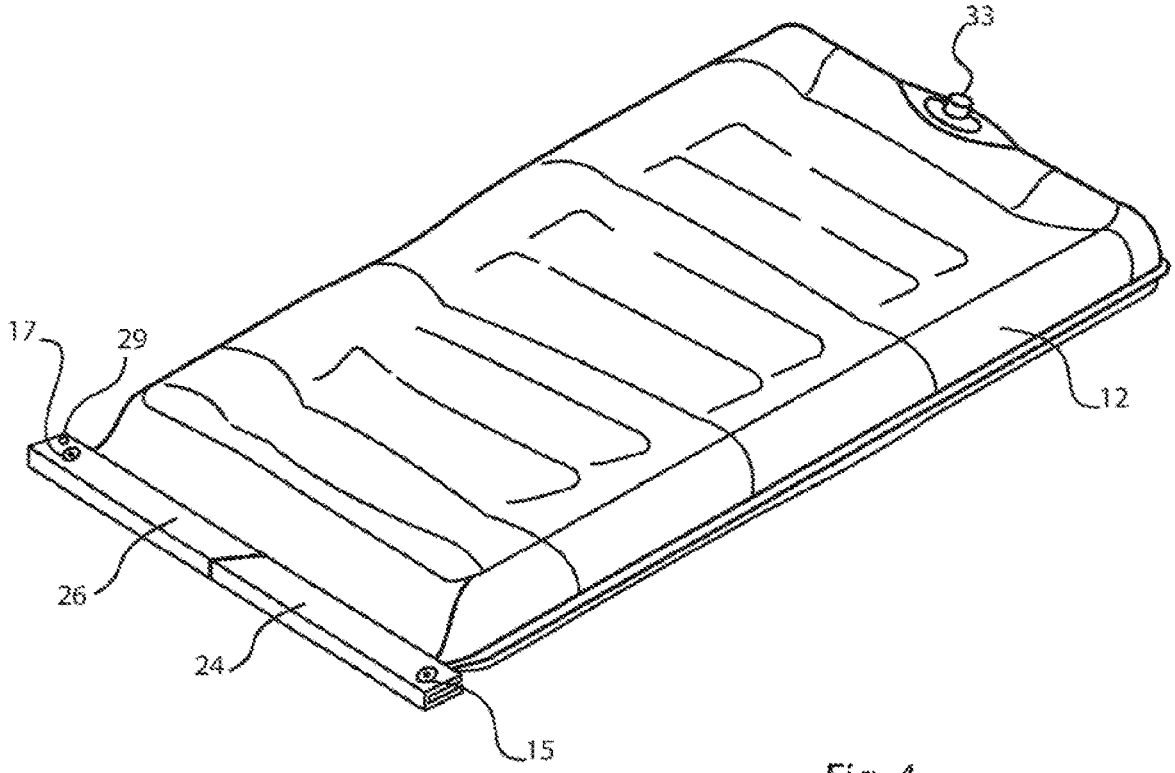
FIG. 4 represents an overview of the device provided with two movable parts.

The closure means also comprise at least one movable part 25 according to FIGS. 1 and 2, and preferably two movable parts 24 and 26 according to FIGS. 3 and 4, made of rigid plastic and having a hollow cross-section, preferably substantially U-shaped so as to form a jaw along their entire length. The preferred embodiment of the device, according to the invention with two movable parts 24 and 26, is illustrated in FIGS. 3 and 4. The movable parts 24 and 26 are pivotally connected to the strips 14 and 16 about an axis located at each end of the strips 14 and 16. The axis of rotation may coincide with the axis of screws 15 and 17. The movable parts 24, 25 and 26 are sized in order to grip the two strips in their jaw so as to keep them clamped against each other over their entire length. According to the preferred embodiment of the invention, the strips 14 and 16 and the movable parts 24, 25 and 26 are straight.

In the position where the movable parts 24 and 26 are placed around the strips 14 and 16, called the closed position in the remainder of the description, air cannot pass between the strips held tight against each other, the leisure device is completely sealed and the air trapped in the pouch cannot escape. The mattress 10, shown in FIGS. 3 and 4, is ready for use. At least one movable part has an orifice 29, which makes it possible to hang the device in order to transform it into a flotation buoy, for example.

Figure 10:
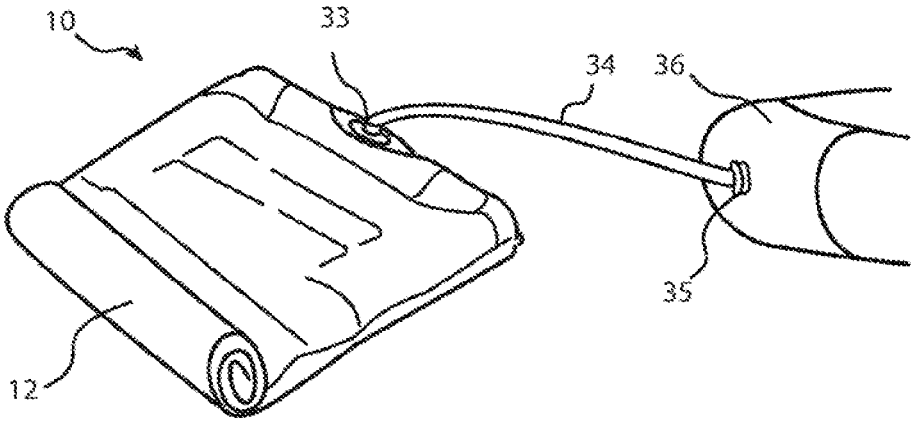
FIG. 10 represents a second use of the device according to the invention.

According to another use of the device according to the invention, the pouch comprises a second opening 33, which acts as an air outlet, the details of which are described with reference to FIG. 10.

Figure 5:
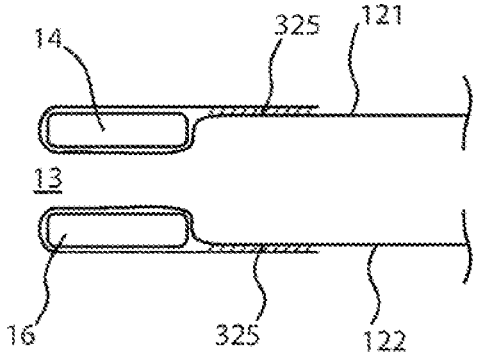
FIG. 5 represents a cross-section of the air inlet opening.

As can be seen in FIG. 5, the two strips 14 and 16 have a substantially rectangular section but have rounded edges in order to limit the risks of piercing the pouch.

The flexible pouch 12 has two walls on either side of the opening, an upper wall 121 and a lower wall 122. The lower wall may be covered with a protective material such as a layer of foam to make the device resistant for use while camping. The edges of each wall, located at the periphery of the opening 13, are each connected to a strip 14 and 16, respectively. According to a preferred embodiment of the invention, the edge of the wall 121 at the periphery of the opening 13 forms a sleeve in which the strip 14 is housed. Likewise, the edge of the wall 122 at the periphery of the opening 13 forms a sleeve in which the second strip 16 is housed. The edge of the wall 121 is therefore wound around the strip 14 and preferably secured against the external side of the wall 121. The attachment illustrated by a hatched area 325 is done by gluing, sealing, welding or stitching. Preferably, according to this embodiment, the walls of the pouch are not glued to the strips 14 and 16.

According to another embodiment of the invention, not shown in the figures, the edge of the wall 121 at the periphery of the opening 13 is glued directly to the strip 14. Likewise, the edge of the wall 122 at the periphery of the opening 13 is glued or welded directly to the second strip 16.

Figure 6:
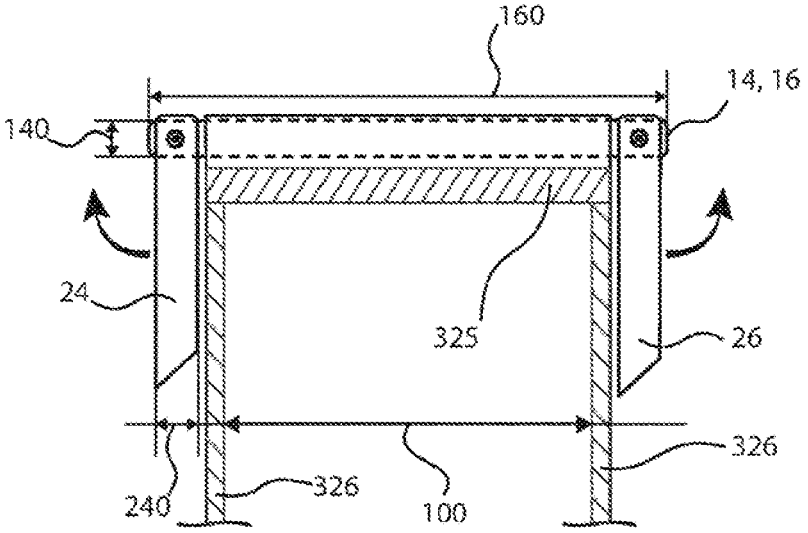
FIG. 6 represents a front view of the air inlet opening and the moving parts in the open position.

According to the top view of FIG. 6, the strips have a length 160 sized so as to be slightly greater than or equal to the dimension 100 of the width of the opening 13, increased by the width of the attachment zones 326 located at the periphery, increased by the width 240 of each movable part present. In all cases, the length 160 of the strips is sized so as to be able to fold the movable parts along the leisure device when they are in their open position, which is more practical for folding the device and for the air filling phase. Strips 14 and 16 have a width 140 of between 1 cm and 4 cm and a thickness of between 1 mm and 4 mm. The attachment zones 325 of the walls 121 and 122 folded back on themselves, located along the sleeves in which the strips 14 and 16 are housed or located directly on the strips in the absence of sleeves, extend along the edges of the mattress by a peripheral attachment zone of the walls 121 and 122 in contact with one another over the entire periphery. In FIG. 6, only part of this attachment zone 326 is shown.

Figure 7:
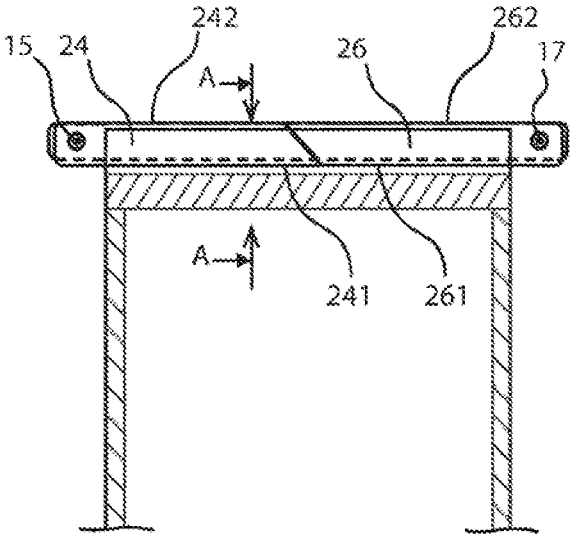
FIG. 7 represents a front view of the air inlet opening and the moving parts in the closed position.

According to FIG. 7 which shows a top view of the opening 13 and the closure means, the two movable parts 24 and 26 have been folded over the strips, i.e. in their closed position, pivoting about their respective axis of rotation 15 and 17 connected to the ends of the strips. The length of the edges of the movable parts is sized so that, when the two movable parts 25 and 26 are in the closed position, the two free ends of the movable parts meet and come into contact in order to hermetically close the opening 13. The "leading edge" denotes the edge of the movable parts through which the strip is inserted into the movable parts and the "trailing edge" denotes the edge of the movable parts directed outwards. Suppose for each moving part, the length of the leading edge is equal to the length of the trailing edge. In that case, the flat faces of the free ends of the moving parts, in contact with one another, are perpendicular to the edge of the opening 13 so that the movable parts 24 and 26 can be placed in their closed position in any order.

According to the preferred embodiment of the invention with two movable parts, each movable part 24 and 26 has a leading edge and a trailing edge of different length. The difference in length between the leading edge 241 and the trailing edge 242 of the movable part 24 is equal to the difference in length between the leading edge 261 and the trailing edge 262 of the movable part 26. In this way, the leading and trailing edges of each movable part are connected, on the free end side of the movable part, by a flat beveled face. In the example shown in FIG. 7, the beveled face of the free end of the movable part 24 is directed towards the outside of the device, while the beveled face of the free end of the movable part 26 is directed towards the inside of the device. This configuration requires that the movable part 24 is put in the closed position before the movable part 26. The angles of the two beveled faces are complementary so that the faces coincide perfectly when the moving parts are in the closed position. This beveled shape and this complementarity of the free end of the moving parts have the advantage of opposing resistance to the pressure of the air contained in the pouch of the mattress. Indeed, when the air pressure pushes on the walls 121 and 122 of the mattress, the pressure is also directed towards the opening 13 and towards the strips and the movable parts 24 and 26, while the opening of the movable part 24 is blocked by part 26 because its beveled end face presses against that of movable part 26. Therefore, the means for closing the opening of the device is self-locking.

Figure 8:
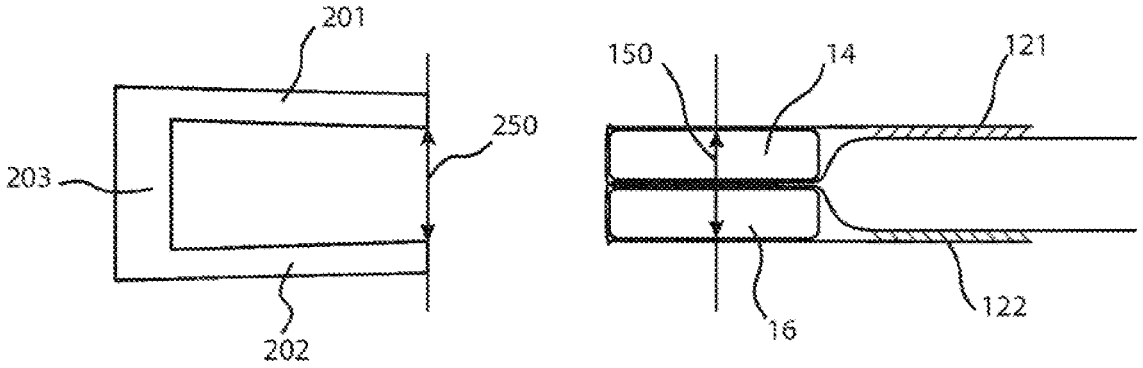
FIG. 8 represents a cross-section of the strips and the movable parts.

FIG. 8 shows a section of the movable part 24, 25 or 26 and a cross-section of the strips 14 and 16. The embodiment shown in FIGS. 8 and 9 corresponds to the mode in which the walls 121 and 122 each form a sleeve for housing the strips therein. The hollow cross-section of the movable part 24, 25 or 26 defines a cavity 210 which is preferably substantially U-shaped and adapted to receive the two strips in their sleeve. The movable parts 24, 25 and 26 comprise two legs 201 and 202 connected to a connection element 203 which is the base of the U. The thickness of the connection element 203 is greater than that of the legs 201 and 202. The connection element 203 thus makes it possible to reinforce the movable part and to increase the resistance to the separation of the two legs.

The interior width between the two legs at the base 203 is greater than the free interior width of the two legs. The "free internal width" denotes the width of the two legs at the leading edge of the moving parts. The free internal width must be between the value of the total thickness including the two thicknesses of strips, the thicknesses of the walls 121 and 122 (one or two thicknesses depending on the embodiment) and this value reduced by 0.5 mm (millimeter).

Figure 9:
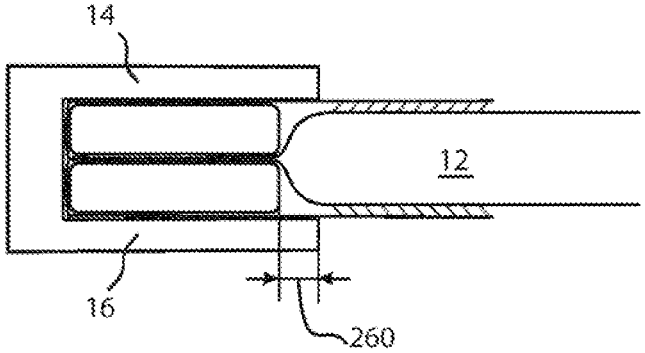
FIG. 9 represents a cross-section of the strips inserted into the movable parts.

At the ends, where the moving parts are connected to the strips by their axis of rotation, the strips are engaged between the legs 201 and 202 of the moving parts. As a result, the user can easily fold the movable parts on the strips because the strips engage easily and automatically between the legs 201 and 202 of the movable parts as the pivoting progresses. When the movable parts are in their closed position, the strips are inserted between the legs 201 and 202 of the movable parts to the bottom of the cavity 210, as shown in FIG. 9 which is a sectional view along AA of FIG. 7. The strips are constrained by the legs 201 and 202 of the movable parts due to the dimensions of the parts. The legs 201 and 202 of the movable parts exert a compressive pressure on the strips 14 and 16 which clamps them against each other and prevents the leakage of the air contained in the pouch 12.

In the embodiment where the portions of the walls 121 and 122 form sleeves and are not glued to the strips 14 and 16, the walls around the strips tend to collapse and spread against the bottom of the cavity 210, so they have the advantage of promoting the tightness of the pouch. This advantage is due to the fact that, when the movable parts are in their closed position, the width of the legs 201 and 202 of the movable parts protrude from the strips, preferably by a distance 260 at least equal to 2 mm. Thus, at their free end, the legs 201 and 202 of the movable parts can be tightened on the strips so as to reinforce the compressive pressure of the legs on the strips. The device according to the invention comprises a second opening 33 which serves as an air outlet, as can be seen in FIGS. 1 to 4 and 10. FIG. 10 shows how the leisure device according to the invention can serve as a pump bag for inflating an inflatable device 36 such as a buoy. To this end, the user connects the leisure device to the inflatable device by connecting a pipe 34 from the second opening 33 to the air inlet opening 35 of the inflatable device. The second opening 33 has a plug and a check valve. The user then rolls up the leisure device on itself or presses the device so as to expel air towards the air outlet 33 and to inflate the inflatable device 36. The second opening 33 can also be used to adjust the inflation of the device according to the invention. Indeed, when the first opening is closed, the user can still allow air to enter the device by removing the plug from the second opening and by blowing either by mouth or with a traditional inflator, the check valve preventing the device from deflating when the plug is removed.

The device according to the invention can also comprise a safety means which is added to the closure means to immobilize the moving parts when they are in the closed position.

Figure 11A:
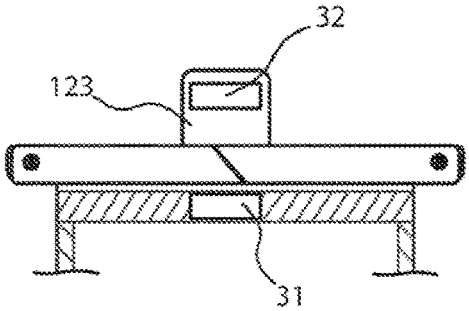
FIG. 11*a* represents a first safety means.
Figure 11B:
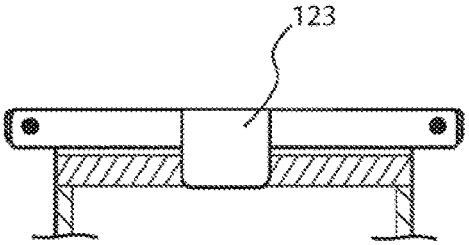
FIG. 11*b* represents the first safety means in engaged position.

A first safety means consists of an attachment means of the hook and loop type illustrated in FIGS. 11*a* and 11*b*.

This means comprises a tab 123 connected to the lower wall 122 provided with a first hook-type strip 32 and a second loop-type strip 31 secured to the upper wall 121 of the device. The two strips being adapted to grip one another when the tab 123 surrounds the movable parts when the latter are in the closed position. The tab 123 and the hook-and-loop strips 31 and 32 are preferably located so as to be close to the free ends of the movable parts 24 and 26. When the two strips are in contact with each other, as illustrated in FIG. 10*b*, the two moving parts are immobilized.

Figure 12A:
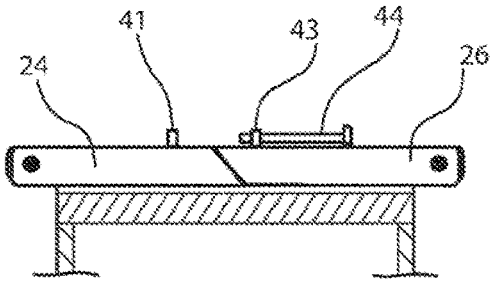
FIG. 12*a* represents a second safety means.
Figure 12B:
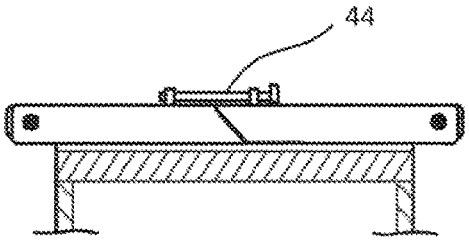
FIG. 12*b* represents the second safety means in engaged position.

A second safety means consists of a rod lock shown in the open position in FIG. 12*a* and in the closed position in FIG. 12*b*. The lock comprises a first part 41 secured on the movable part 24 and a second part 43 secured on the second movable part 26, the two fixed parts 41 and 43 being located near the free ends of the movable parts. The rod lock also comprises a rod 44 which acts as a bolt, held to slide in the fixed part 43 so that it can, preferably, slide without being detached from the fixed part and therefore from the device. A user can push the rod so as to engage it in the second fixed part 41 and to immobilize the two movable parts. The two fixed parts 41, 43 and the rod of the lock can also be provided with notches and pins, in the manner of a bolt guide lock, to hold the rod in place, either in the position of the open lock or in the position of the closed lock.

Figure 13A:
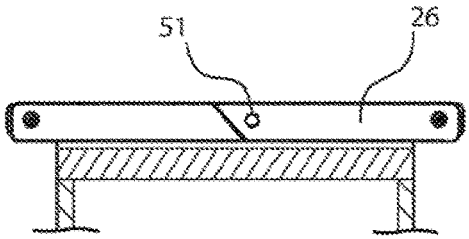
FIG. 13*a* represents a third safety means.
Figure 13B:
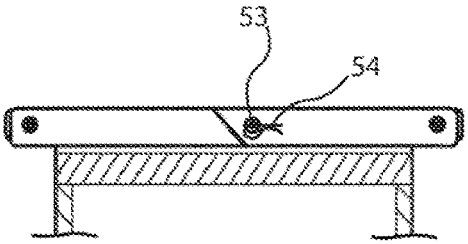
FIG. 13*b* represents the third safety means in engaged position.

A third safety means illustrated in FIGS. 13*a* and 13*b* consists of a hollow pin 53 and a fixing ring or rod 54, the hollow pin being adapted to be inserted into an orifice 51 passing through the movable part 26 and the strips that it encloses. In the case of a device with two moving parts, the orifice is located on the side of the moving part whose leading edge is the shortest. In the case of a device with a single movable part, the orifice is preferably located on the side of the free end of the movable part. The immobilization of the moving parts is obtained when the rod is inserted into the orifice and the fixing ring or rod is inserted into the hole of the hollow pin. The second mobile part 24 can also be provided with this safety means.

Figure 14A:
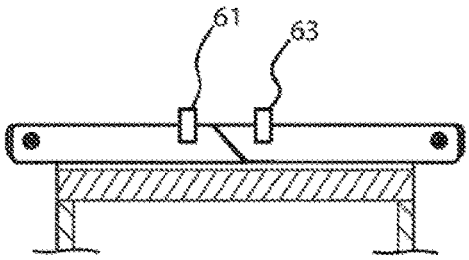
FIG. 14*a* represents a fourth safety means.
Figure 14B:
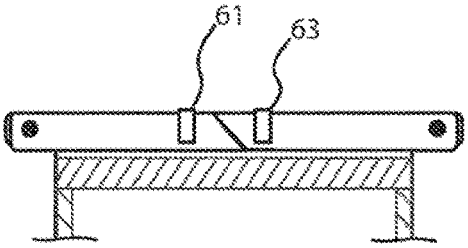
FIG. 14*b* represents the fourth safety means in engaged position.
Figure 15:
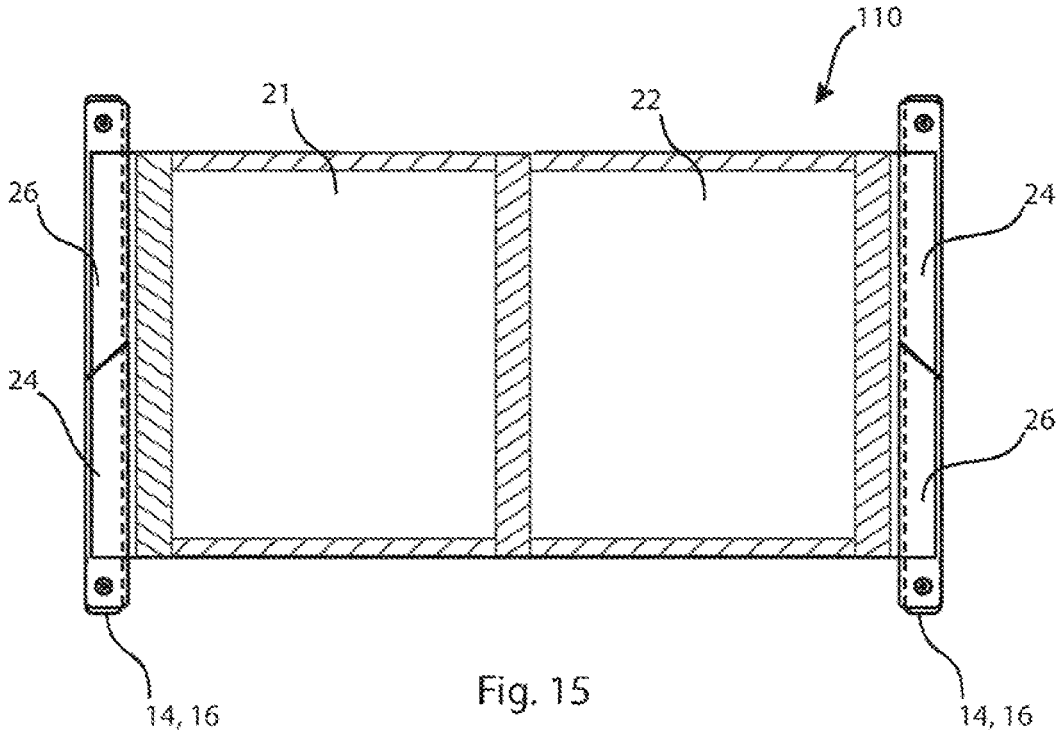
FIG. 15 represents a first alternative embodiment of the device according to the invention.
Figure 16:
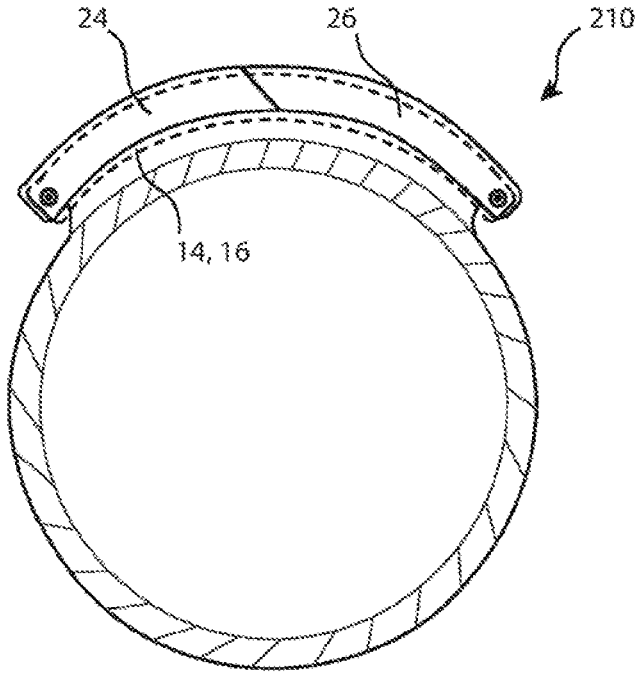
FIG. 16 represents a second alternative embodiment of the device according to the invention.

A fourth safety means illustrated in FIGS. 14*a* and 14*b* consists of a sliding clamp 61, 63 located at the free end of the moving parts. Each clamp slides between two positions, a first position where it exerts no force on the legs of the movable part and a second position where it exerts a force on the legs of the movable part which tends to tighten them towards each other and prevent their separation. When the movable parts are in their open position or are being handled to move from one position to another, the clamp is in its first position as shown in FIG. 14*a*. When the movable parts are in the closed position, the clamps are moved to their second position so as to immobilize the movable parts as illustrated in FIG. 14*b*. The clamps 61 and 62, which are obtained by casting, are integral with the moving parts so that they are linked to them.

The four safety means described above can be combined, for example lock plus hook-and-loop strips or clamps plus hook-and-loop strips.

On the other hand, the outer sides of the moving parts can be covered with a flexible material such as foam so that the device according to the invention does not have any hard surface which could injure someone. "External faces of the mobile parts" relate to the faces which are not in contact with the strips.

Advantageously, the device according to the invention has child safety which consists in preventing any risk of suffocation of the child entering the pouch. To this end, the device is provided with a mosquito net-type closing web which has the particularity of being permeable to air. The web is secured inside the pouch on the periphery of the opening so as to close the opening 13 and to prevent the penetration of a child inside the pouch. The sealing web is dimensioned so as not to interfere with the separation of the strips during the inflating phase of the device and to remain in the device when the moving parts are moved into their closed position.

According to a first alternative embodiment of the device according to the invention, the device comprises several pouches, each delimiting a volume of air, each pouch has a peripheral fixing zone 326 of the upper wall with the lower wall so that the pouches do not communicate with each other. According to the example shown in FIG. 14, the device comprises two air volumes 21 and 22. Each air volume comprises an air inlet opening and means for closing the air inlet opening, in all respects identical to those described for a single air volume pouch. Each air volume is filled and closed one after the other. This alternative embodiment can be used to produce a leisure device according to the invention in the form of a seat for example.

According to a second alternative embodiment, the shape of the device according to the invention is such that the air inlet opening is curved to produce a leisure device in the form of a buoy for example. Such an embodiment comprises strips 14, 16 and movable parts 24, 26 curved so as to match the shape of the air inlet opening. The technical characteristics described for a straight air inlet remain valid for a curved air inlet.

According to a third alternative embodiment of the device according to the invention, each strip is composed of two half strips so as to be able to fold them to store the device. The half strips are then connected by a piece of flexible plastic so as to correctly hold the strips in place and allow them to be folded.

Advantageously, the device according to the invention can be used as an aquatic, beach and camping mattress, as an inflator, as a garden furniture, as a flotation and signaling buoy, as a waterproof bag and a food bag.

The invention claimed is:

1. A device (10, 110, 210) comprising at least one flexible pouch (12, 21, 22) delimiting an interior volume, one air inlet opening (13) per flexible pouch to allow air to pass into the interior volume of the pouch, a closure means for closing the air inlet opening in an airtight manner, the closure means comprising two flexible strips (14, 16) located at the periphery of the air inlet opening, the strips being connected at their ends and intended to be pressed against one another, wherein the device further comprises at least one rigid movable part (24, 25, 26) pivotally connected to one of the ends of said strips such that said at least one rigid movable part can be positioned around the strips in a closed position in which the two strips are kept clamped together so as to prevent air from escaping the device when the latter is filled with air.

2. The device according to claim 1, wherein said at least one flexible pouch (12, 21, 22) has two walls on either side of said opening (13), an upper wall (121) and a lower wall (122), the edge of the upper wall (121) at the periphery of the opening (13) being connected to one of said strips (14) and the edge of said lower wall (122) at the periphery of the opening (13) being connected to the other of said strips (16).

3. The device according to claim 2, wherein the edge of the upper wall (121) is wrapped around one of said strips (14) and secured against the outer side of the upper wall (121) and the edge of the lower wall (122) is wrapped around the other of said strips (16) and secured against the external side of the lower wall (122) so that each wall (121, 122) forms two sleeves in which the strips (14, 16) are housed, said walls not being glued on said strips.

4. The device according to claim 2, wherein the edge of the upper wall (121) is glued or welded directly to the internal face of one of said strips (14) and the edge of the lower wall (122) is glued or welded directly to the internal face of the other of said strips (16).

5. The device according to claim 1, wherein said at least one rigid movable part (24, 25, 26) has a cross-section defining a substantially U-shaped cavity and adapted to receive said two strips (14, 16), the at least one rigid movable part (24, 25, 26) comprising two legs (201 and 202) connected to a connection element (203) which is the base of the U, the interior width between the two legs at said base (203) being greater than the free internal width (250) of both legs.

6. The device according to claim 2, wherein said lower wall (122) can be covered with a protective material such as a layer of foam to make the device resistant.

7. The device according to claim 1, wherein at least one movable part has an orifice (29) which allows the device to be hooked.

8. The device according to claim 1, wherein said strips (14, 16) and said at least one rigid movable part (24, 25, 26) is curved.

9. The device according to claim 1, further comprising a safety means for immobilizing said at least one rigid movable part when said at least one rigid movable part is in the closed position.

10. The device according to claim 9, wherein said safety means comprises a tab (123) connected to said lower wall (122) and provided with a first hook-type strip (31) and a second loop-type strip (32) secured to said upper wall (121) of the device so as to be able to cooperate with said first strip (31) when said tab (123) surrounds the at least one rigid movable part when the latter is in the closed position.

11. The device according to claim 9, wherein said safety means is a hollow pin (53) and a fixing ring or rod (54), the hollow pin being adapted to be inserted into a hole (51) passing through at least one mobile part (26) and the strips which the at least one mobile part encloses.

12. The device according to claim 9, wherein said safety means is a clamp (61, 63) located at a free end of said at least one rigid movable part, each clamp sliding between two positions, a first position where the clamp exerts no force on the legs of said at least one rigid movable part and a second position where said clamp exerts a force on the legs of the at least one rigid movable part which tends to tighten the legs towards the other and prevent their separation.

13. The device according to claim 1, comprising a second opening (33) provided with a plug, adapted to connect an air inlet opening (35) of an inflatable device (36) by means of a pipe (34), said inflatable device (36) being inflatable by expelling air from said device (10, 110, 210) towards the second opening (33).

14. The device according to claim 1, comprising an air-permeable closure web secured inside the at least one flexible pouch (12, 21, 22) on the periphery of the opening (13) so as to close said opening (13), the sealing web being sized so as not to interfere with the spacing of the strips during the air filling phase of the device.

15. The device according claim 1, wherein the outer faces of the at least one rigid movable part (24, 25 26) are covered with a flexible material such as foam.

16. The device according to claim 1, comprising two movable parts (24 and 26), each movable part (24 and 26) having a leading edge (241, 261) and a trailing edge (242, 262) of different length, the difference in length between the leading edge (241) and the trailing edge (242) of one of the movable parts (24) being equal to the difference in length between the leading edge (261) and the trailing edge (262) of the movable parts (26), the length of said edges of the two other of the movable parts being sized so that, when the two movable parts (25 and 26) are in the closed position, free ends of the movable parts come together and make contact.

17. The device according to claim 16, wherein each movable part has at its free end a beveled planar face connecting the leading edge and the trailing edge, the beveled face of the free end of one of said movable parts (24) is directed towards the outside of the device while the beveled face of the free end of the other of said movable parts (26) is directed towards the inside of the device, the angles of the two beveled faces being complementary so that the beveled faces coincide perfectly when said movable parts are in the closed position.

18. The device according to claim 16 comprising a safety means such as a rod lock comprising a first part (41) secured on one of said movable parts (24) and a second part (43) secured on the other of said movable parts (26), the two secured parts (41 and 43) being located near the free ends of the movable parts, said rod lock also comprising a rod (44) which acts as a bolt, held to slide in the second part (43), the rod (44) being moved and engaged in the first part (41) when said two movable parts are in their closed position.

* * * * *